United States Patent [19]

Timmerman

[11] 3,971,729

[45] July 27, 1976

[54] PREPARATION OF GAS GENERATION GRAIN

[75] Inventor: Hubert G. Timmerman, Manhattan Beach, Calif.

[73] Assignee: Specialty Products Development Corporation, Medino, Ohio

[22] Filed: Sept. 14, 1973

[21] Appl. No.: 397,296

[52] U.S. Cl. ..... 252/187 R; 23/281; 60/217; 149/77; 149/83; 252/188.3 R; 280/741

[51] Int. Cl.[2] ..... C06B 29/08

[58] Field of Search ..... 252/188.3 R, 187 R; 280/150 AB; 60/217; 149/83, 77; 23/281

[56] References Cited

UNITED STATES PATENTS 3,837,942 9/1974 Catanzarite ..... 149/83

*Primary Examiner*—Benjamin R. Padgett
*Assistant Examiner*—Irwin Gluck
*Attorney, Agent, or Firm*—Christie, Parker & Hale

[57] ABSTRACT

A technique is provided for making a granulated propellant suitable for gas generation for an automobile passenger restraint bag. The propellant is about ¼ anhydrous nickel formate and ¾ potassium chlorate. The dry powders are blended and mixed with about 12 to 15% of liquid comprising water and up to 50% methanol. The blended mixture is granulated and dehydrated.

10 Claims, No Drawings

PREPARATION OF GAS GENERATION GRAIN

BACKGROUND

Governmental regulations for automobile passenger restraint systems include an inflatable bag that momentarily and temporarily restrains a passenger during the critical instant of a collision impact. For safe and successful use the bag must be inflated in a very short time and thereafter deflated to release the passenger. The gas used to inflate the bag must be cool enough to avoid damage to the bag and injury to the passenger. Hot particles should be kept out of the bag. The inflation gas should also be non-toxic.

Some passenger restraint bags have been inflated with gas stored at high pressure and rapidly released into the bag. Another technique is to employ a gas generator having a solid composition which burns to produce substantial gas volumes. Preferably the combustion gasses produced are primarily carbon dioxide, water vapor, and oxygen, so that no toxic materials are released in the passenger compartment. It has been found that an excellent gas generation composition comprises about ¼ or more anhydrous nickel formate and up to about ¾ potassium chlorate. Such a composition burns evenly to produce large volumes of non-toxic gas. The net heat of reaction is low so that the gasses are not unduly hot as they enter the bag.

In manufacturing a gas generation composition the raw materials are preferably in powder form so that intimate mixture is obtained.

A gas generator for a passenger restraint system is installed when the automobile is manufactured and must remain ready for use throughout the life of the car. During this period it is subject to vibration and both high and low temperature extremes. Powders in a gas generator, therefore, may be undesirable because of potential segregation or packing due to vibration. It is also desirable to reduce dust problems when handling such compositions since the materials may be harmful and are combustible. A technique is therefore desirable for forming a propellant grain free of the problems of powders. Such a grain must have sufficient strength to withstand handling and long life in the gas generator.

BRIEF SUMMARY OF THE INVENTION

Thus in practice of this invention according to a presently preferred embodiment there is provided a process for preparing a propellant grain by mixing anhydrous nickel formate and an oxidizer powder selected from the group of alkali metal chlorates and perchlorates. The mixture is blended with more water than sufficient to form nickel formate dihydrate, agglomerated, and dehydrated.

DESCRIPTION

The materials used in practice of this invention in a presently preferred embodiment are a metal organic fuel and an oxidizer. The preferred fuel is anhydrous nickel formate and the preferred oxidizer is a chlorate or perchlorate of one of the alkali metals such as sodium or potassium. Nitrates and other oxidizer compound powders may also be used as will be apparent to one skilled in the art. Preferably the oxidizer is potassium chlorate because of its preferred burning characteristics with the anhydrous nickel formate. Both the fuel and oxidizer are used in the form of powders having a particle size less than about 25 microns in order to obtain very intimate mixture. Preferably the powders are smaller than about 10 microns. The oxidizer powder is substantially completely free of moisture content.

Nickel formate is commercially available in the form of nickel formate dihydrate powder. The water of crystallization is removed by heating the powder at a temperature of about 275°F until a constant weight is obtained. It has been found to be quite important that the nickel formate be substantially anhydrous for practice of this invention.

The proportion of fuel and oxidizer powder used in the gas generator preferably has oxidizer in excess of the stoichiometric ratio for producing carbon dioxide and water vapor as gaseous reaction products. This assures completeness of the reaction and supresses carbon monoxide formation. In addition, an excess of oxygen remains in the reaction gasses. This is true since at the elevated temperatures of reaction the alkali metal chlorates and perchlorates decompose to produce free oxygen. The excess of oxidizer over stoichiometry assures that a portion of the free oxygen remains in the gas rather than reacting with the nickel formate.

Particularly preferred compositions comprise about ¼ to ⅓ anhydrous nickel formate and ⅔ to ¾ potassium chlorate by weight. Such compositions burn at a good rate without generation of excess heat and the gases produced are near optimum composition. Flame temperatures are low enough that the gases can be sent substantially directly into the restraint bag.

If desired, small quantities of other fuels may be added to the composition as burning rate enhancers. Other metal organic compounds in addition to nickel formate having higher net heats of reaction can be included. Similarly, carbohydrates such as starch, sugar, or the like, can also be included in the composition. Generally it is not found necessary to enhance the burning rate of the composition and such may be detrimental since flame temperatures are raised.

After the nickel formate dihydrate powder has been substantially completely dehydrated by heating it is dry blended with the oxidizer powder. Typically for example, this is accomplished by sieving the dry ingredients together to break up any particle agglomeration; thereafter the powders may be further mixed on a conventional ribbon blender or other commercially available blending machine. As much as thirty minutes of such blending is desirable to assure complete mixing. If the dry powders are not thoroughly blended, caking and segregation may occur when they are moistened. Segregation results in uneven burning and generation of undesirable carbon monoxide.

The mixture of dry powders is then placed in a conventional rotary blender with water. The quantity of water that is added is in excess of the amount required to form nickel formate dihydrate. It is believed that this is important so that some solution of nickel formate and potassium chlorate can occur in the blend.

Moistening of the composition is needed for subsequent granulation of the mixture. This moistening is obtained by the added water, and, if desired, other liquids miscible with water. The total quantity of liquid that is added is preferably in the range of about 12 to 25% of the dry weight of the mixture. That is, about 120 to 250 milliliters of liquid are added to each kilogram of dry mixture. Such a moistened mixture is blended from about three to eight minutes in the rotary blender to bring the consistency of the wetted mixture to a proper value for further processing.

The blended moistened mixture is then passed through an ordinary wet sieve granulator using a 14 mesh screen as the medium through which the material is pressed. This granulation step forms irregularly shaped lumps, particles or granules from the mixed powders. Such wet extrusion is the preferred form of agglomeration for the small particles used in the gas generator. Other agglomeration techniques can be used such as granulating by compacting and crushing, or nodulizing.

After granulating, the particles are substantially completely dehydrated to remove the water. Thus, for example, the particles may remain at room temperature for at least 2 hours followed by drying at about 275°F for 14 to 16 hours. An additional 2 hours at 350°F assures substantially complete dehydration.

It is an important feature of this technique for making a granulated gas generator composition that the nickel formate dihydrate powder be substantially completely dehydrated prior to blending and mixing with the water. Nickel formate is commercially obtained as nickel formate dihydrate. Attempts to make the gas generator composition by mixing the nickel formate dihydrate with the oxidizer powder followed by granulation and drying have resulted in significantly more expensive processing. The water of crystallization must be removed in the finished product and very long drying times are needed to dehydrate formed granules. This is believed to be due to long diffusion times for water to escape from the granules. Further, the total quantity of water is higher since water is added to obtain a proper consistency for granulation in addition to the water of crystallization already present.

The strength of particles granulated by wet pressing and drying is obtained by some solublizing of the ingredients of the composition. It may be that better combination of the oxidizer powder is obtained when the water of crystallization of the nickel formate has been initially removed. A co-crystallization of the fuel and oxidizer may yield higher strength than crystallization of either component alone. The nature of the material in the granules after partial solution in water and subsequent dehydration is not known.

Proper moistening of the mixture for granulation requires the addition of liquid which must thereafter be removed. It is important to use water as at least a portion of the moistening liquid to insure that some solubilizing of the nickel formate and oxidizer powder occurs. Subsequent dehydration requires removal of the moistening liquid, and preferably a liquid having a vaporization rate higher than that of water is substituted for a portion of the water. A particularly suitable material has been found to be methanol which can be substituted for water up to about 50%. The methanol evaporates rapidly and no substantial toxicity or flammability problems are involved. The methanol content of the moistening liquid can be up to about 50%. If the methanol exceeds about 50%, the strength of the dried granules is significantly lowered. If 100% methanol is used, for example, the dried granules have substantially no strength at all and readily crumble back to powder.

The total quantity of liquid used for moistening the granules depends to some extent on the granulator employed and the skill of the operator of the granulating apparatus. A minimum quantity of liquid appears to be about 12%, based on the dry weight of the powder, in order to obtain granules of sufficient strength. Over about 25% liquid makes the granules somewhat sticky so that they stick together and are not free flowing after drying. Preferably the total quantity of liquid is nearer the low end of the range so that less liquid must be removed in subsequent drying.

As mentioned, the liquid comprises at least 50% water and may include other liquids miscible therewith with higher evaporation rates. Thus other alcohols than methanol, acetone, methyl ethyl ketone, low-boiling ethers, formaldehyde, acetaldehyde and other low boiling liquids miscible with water may be substituted. This moistening material should certainly be evaporated at a temperature that removes all water from the dried mixture.

After the mixture has been granulated and thoroughly dried it is ready for use in the gas generator. It should be stored in closed containers and protected from water pickup in the gas generator. The material is somewhat hygroscopic and it is preferred that the gas generator be hermetically sealed to assure long life without deterioration. Adequate strength is obtained in the granules by moistening with water prior to granulation. If desired, granule strength can be enhanced by use of conventional binders such as phenolic resins, polyvinyl alcohol, polyvinyl acetate, cellulose acetate, starch and the like. It is found that a minimum of about 5% of such binder is needed in the composition in order to obtain adequate strength. Addition of this amount of organic material adds fuel and raises the net heat of reaction significantly. This raises the flame temperature when the composition is burned and may make the composition unsuitable for use in a gas generator where the gases are sent directly into the inflatable bag. By moistening the anhydrous nickel formate and oxidizer powder with water, the use of binders can be avoided.

Although limited embodiments of technique for preparing gas generator grain have been described herein, many modifications and variations will be apparent to one skilled in the art. Thus various techniques for dry blending, moistening, agglomerating and drying can be adapted for use in this process. It is therefore to be understood that within the scope of the appended claims, the invention may be practiced otherwise than as specifically described.

What is claimed is:

1. A process for preparing a deflagration gas generation mixture comprising the steps of:

mixing substantially anhydrous nickel formate powder with an oxidizer compound powder;

blending the mixture with a liquid having more water than sufficient to form nickel formate dihydrate;

agglomerating the blended mixture; and substantially completely dehydrating the agglomerated mixture.

2. A process as defined in claim 1 further comprising the preliminary step before the mixing step of forming anhydrous nickel formate by substantially completely dehydrating nickel formate dihydrate by heating.

3. A process as defined in claim 2 wherein the agglomeration step comprises granulation by wet sieving.

4. A process as defined in claim 1 wherein the quantity of liquid added in the blending step is in the range of from about 12 to 25% by weight of the dry mixture.

5. A process as defined in claim 4 wherein the mixture comprises about ¼ to ⅓ anhydrous nickel formate and about ⅔ to ¾ alkali metal chlorate or alkali metal perchlorate.

6. A process as defined in claim 4 wherein the liquid is at least about 50% water and up to about 50% liquid miscible with water and vaporizable more rapidly than water.

7. A process as defined in claim 6 wherein the liquid comprises up to about 50% methanol.

8. A product produced according to the process of claim 1.

9. A process as defined in claim 1 wherein the agglomeration step comprises granulation by wet sieving.

10. A process as defined in claim 1 wherein the oxidizer compound powder is selected from the group consisting of chlorates, perchlorates and nitrates.

* * * * *